US009244437B2

(12) United States Patent
Grandjean et al.

(10) Patent No.: US 9,244,437 B2
(45) Date of Patent: Jan. 26, 2016

(54) DEVICE FOR WINDING A TIMEPIECE BY MEANS OF THE CROWN

(71) Applicant: OMEGA SA, Biel/Bienne (CH)

(72) Inventors: Luc-Alain Grandjean, Reconvilier (CH); Antoine Hirschi, Bienne (CH); Bastien Paratte, Courtelary (CH); Maxence Perret-Gentil, La Chaux-de-Fonds (CH)

(73) Assignee: Omega SA, Biel/Bienne (CH)

( * ) Notice: Subject to any disclaimer, the term of this patent is extended or adjusted under 35 U.S.C. 154(b) by 0 days.

(21) Appl. No.: 14/637,766

(22) Filed: Mar. 4, 2015

(65) Prior Publication Data

US 2015/0277383 A1 Oct. 1, 2015

(30) Foreign Application Priority Data

Mar. 26, 2014 (EP) ..... 14161670

(51) Int. Cl.

| | |
|---|---|
| ***G04C 1/00*** | (2006.01) |
| ***G04C 1/04*** | (2006.01) |
| ***G04D 7/02*** | (2006.01) |
| ***G04C 1/06*** | (2006.01) |
| ***G04B 3/00*** | (2006.01) |
| *G04D 7/00* | (2006.01) |

(52) U.S. Cl.

CPC ..... *G04C 1/003* (2013.01); *G04B 3/006* (2013.01); *G04C 1/04* (2013.01); *G04C 1/06* (2013.01); *G04D 7/009* (2013.01)

(58) Field of Classification Search

CPC ..... G04B 3/00; G04B 3/006; G04C 1/00; G04C 1/003; G04C 1/04; G04C 1/06; G04C 1/065; G04C 1/10; G04C 1/12; G04D 7/009

USPC ..... 368/147, 149, 206, 209

See application file for complete search history.

(56) References Cited

U.S. PATENT DOCUMENTS 2,588,042 A * 3/1952 Poltrock ..... G04B 3/006 185/39
3,620,007 A * 11/1971 Kauffman ..... G04D 7/009 368/206

(Continued)

FOREIGN PATENT DOCUMENTS

| | | |
|---|---|---|
| DE | 20 2010 004 668 U1 | 7/2010 |
| DE | 20 2013 005 715 U1 | 8/2013 |
| EP | 1 220 061 A1 | 7/2002 |

OTHER PUBLICATIONS

European Search Report issued Dec. 15, 2014 in European Application 14161670, filed on Mar. 26, 2014 (with English Translation).

*Primary Examiner* — Vit W Miska

(74) *Attorney, Agent, or Firm* — Oblon, McClelland, Maier & Neustadt, L.L.P.

(57) ABSTRACT

The invention relates to a device for winding a timepiece by means of the crown, said device including:

- a body having at least two housings inside which are respectively arranged a motor, a rechargeable battery, and an electronic control circuit,
- means for driving the crown disposed at one of the ends of the body of the device and secured to said motor, intended to rotatably drive said timepiece crown, According to the invention, the device includes a spring placed between said battery and said motor to permit said motor to slide in its housing with said drive means inside the body of said device, said motor being configured to slide into at least two positions, including:

- a rest position in which said motor is not supplied with power, and
- an operating position in which said motor is supplied with power in order to start the rotation of said drive means when said drive means are engaged and pressed onto the crown of said watch.

10 Claims, 2 Drawing Sheets

(56) References Cited

U.S. PATENT DOCUMENTS 3,774,389 A * 11/1973 Wilken ..... G04B 3/006 368/216
4,057,958 A * 11/1977 Wuntch ..... G04B 3/006 368/207
5,988,871 A * 11/1999 Bonnet ..... G04D 7/009 368/206
6,910,802 B2 * 6/2005 Rustioni ..... G04D 7/009 368/206
7,575,367 B2 * 8/2009 Wolf ..... G04D 7/009 368/206
8,579,499 B2 * 11/2013 Moroni ..... G04B 3/006 368/209
2002/0136095 A1 9/2002 Agnoff
2005/0000323 A1 1/2005 Agnoff

* cited by examiner

DEVICE FOR WINDING A TIMEPIECE BY MEANS OF THE CROWN

This application claims priority from European Patent application 14161670.6 of Mar. 26, 2014, the entire disclosure of which is hereby incorporated herein by reference.

The present invention relates to the field of horology. It concerns, more specifically, a device for winding a mainspring of a timepiece by means of the crown, and more particularly for a manually wound watch.

Generally speaking, such devices permit a winding crown to be rotatably driven with no direct contact between the user and the crown in order to wind the mainspring of a timepiece movement fitted to the watch.

DE Patent No 2020130057155 discloses a device for winding or tightening a mainspring by means of the crown, comprising a cylindrical body inside which are disposed, in an aligned manner, an electric motor and an electronic control circuit in addition to a battery for powering the same. A rubber endpiece having an outwardly opening cavity is disposed at one of the ends of the body and can receive any type of crown, the endpiece being integral with the output shaft of the electric motor. The motor is switched on and off by a conventional switch or push button type switch arranged on the body.

DE Patent No 202010004668 also discloses a device for winding a mainspring having a cylindrical body inside which are disposed an electric motor, a reduction gear and a battery for powering the motor. The device also has a flexible, hollow endpiece secured to the output shaft of the electric motor and arranged to receive the watch crown and a switch for switching on the motor.

US Patent No 2005/0000323 also discloses a winding device of this type whose hollow endpiece is interchangeable to adapt to fit various crown shapes, this device further including a torque limiter.

One drawback of the aforementioned devices is that they all require manual actuation of a switch after insertion of the watch crown into the endpiece cavity.

Yet another drawback of such devices is that they are not easy to operate for the user handling the device.

It is an object of the present invention to overcome these multiple drawbacks, by proposing a device for winding a timepiece mainspring, which is universal, easy to use and economical to manufacture.

More specifically, it is an object of the invention to provide a winding device which does not require manual actuation of a switch by the user.

These objects, in addition to others which will appear more clearly hereafter, are achieved according to the invention with the aid of a device for winding a timepiece mainspring by means of the crown, the device including:

- a body inside which are respectively arranged a motor, an electronic unit for controlling the motor and a device for powering the circuit and the motor,
- means for driving the crown disposed at one of the ends of the body of the device and secured to an output shaft of the motor, intended to rotatably drive the timepiece crown, the winding device being characterized in that it includes a spring placed between the battery and the motor to permit the motor to slide with the drive means inside the body of the device, the motor being arranged in the body to slide into at least two positions, including:

- a rest position in which the motor is not supplied with power, and

- an operating position in which the motor is powered in order to start the rotation of the drive means when the drive means are engaged and pressed onto the watch crown.

According to optional characteristics of the invention, taken alone or in combination:

- the motor has a third position in which the motor is not supplied with power when the pressure exerted on the drive means is greater than a predetermined threshold,
- the device includes a switch cooperating with an electronic circuit, called the motor circuit, opening or closing the switch so as to supply or shut off power to the motor,
- the electronic control circuit includes torque limiting means and/or revolution counter means,
- the torque limiting means and/or the revolution counter means are coupled to means for displaying the torque and/or number of revolutions,
- the drive means include a hollow endpiece intended to receive the crown,
- the hollow endpiece is made of an elastomeric material,
- the hollow endpiece is removably connected to the drive means,
- the device includes a rechargeable battery and battery charging means,
- the battery, the motor, the spring, the drive means and the endpiece are aligned along the same axis traversing the body of the device lengthwise.

Thus, by means of its various functional and structural aspects defined above, the subject of the present invention can ensure reliable and simple winding of a manually wound or self-winding watch.

Other characteristics and advantages of the invention will appear more clearly upon reading the following description of a specific embodiment of the invention, given simply by way of illustrative and non-limiting example, and the annexed Figures, among which:

Figure 3A:
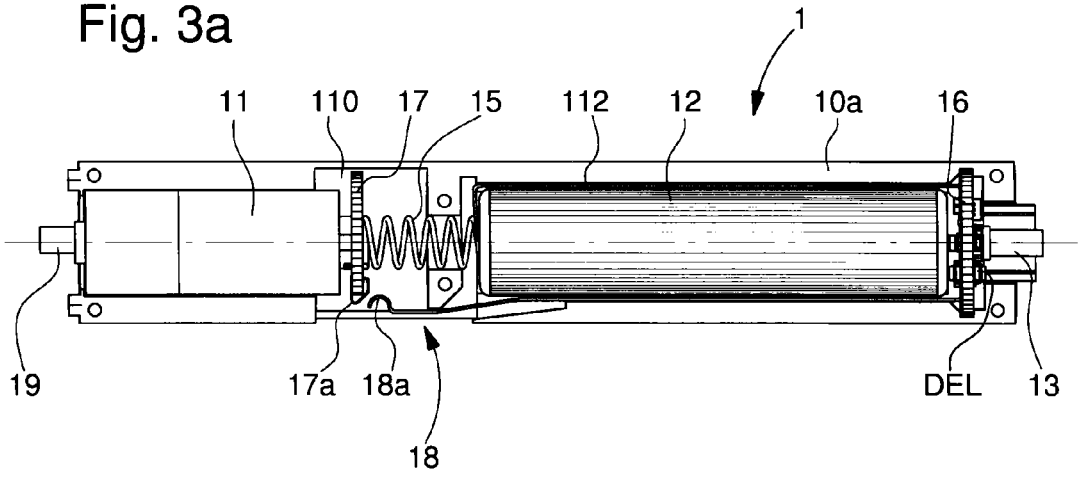
Figure 3B:
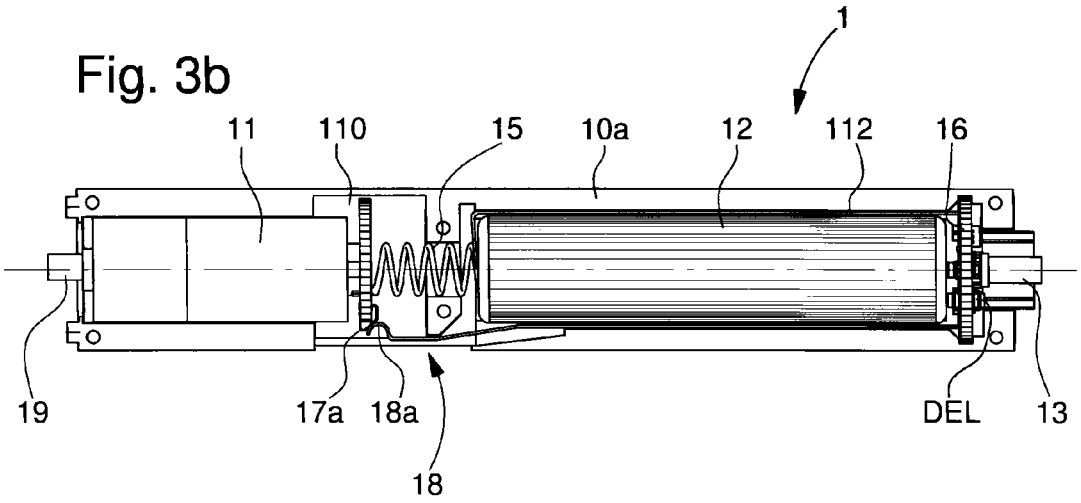
Figure 3C:
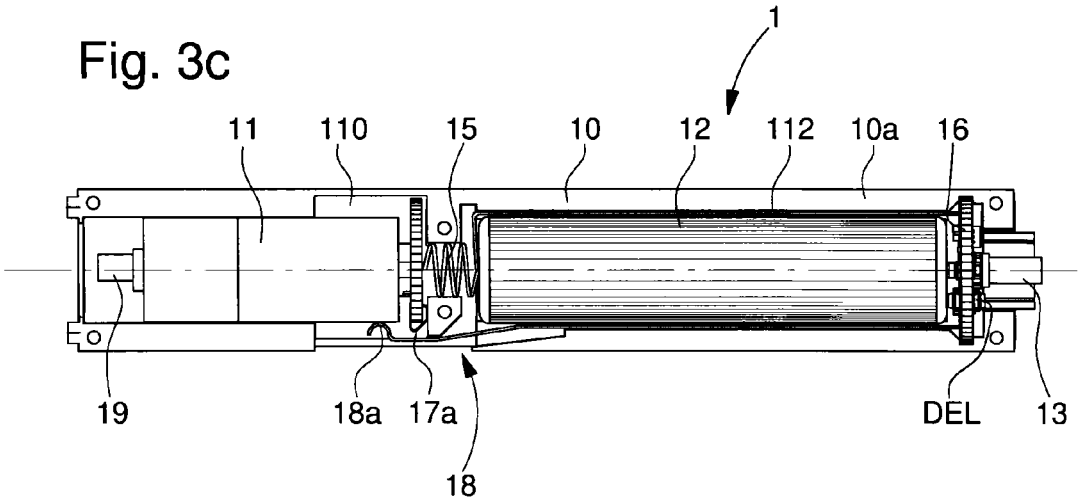

FIGS. 3*a* to 3*c* are respectively side views of a winding device according to the invention in the rest position, in the operating position, and in the stop position, with one portion of the body of the device having been removed.

An example embodiment of a device for winding a mainspring of a timepiece movement by means of the crown, designated by the general reference 1 will now be described below with reference jointly to FIGS. 1, 2 and 3*a* to 3*c*.

Figure 1:
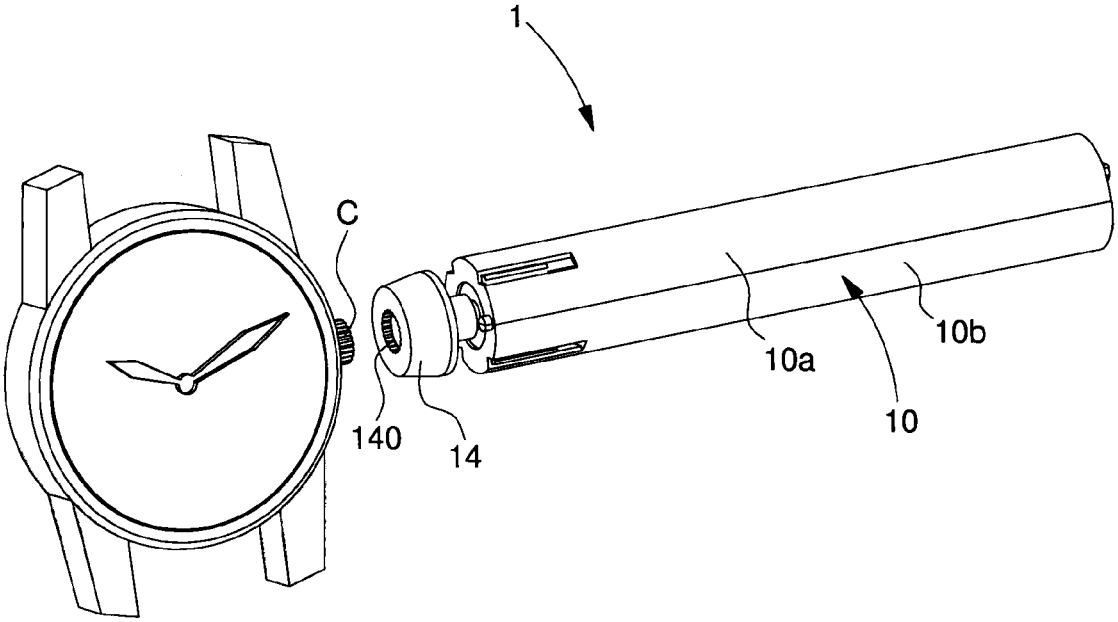
FIG. 1 is a perspective view of the winding device according to the invention.

As stated above, the general principle of the invention lies in the implementation of a portable winding device 1 enabling the mainspring to be wound by means of the crown C of a manual or automatic watch, schematically shown in FIG. 1.

In this example, device 1 is formed of a body 10 having at least two housings 110 and 112 intended to receive respectively a direct current electric motor 11, a powering device, in this case a battery 12 which may or may not be rechargeable, and an electronic control circuit 16 disposed at one of the ends of body 10. The powering device is arranged to power the electronic control device and the electric motor 11. In a variant, the battery could be replaced by a power input connected to the power grid by an electrical connecting cord via an AC-DC converter which may or may not be integrated in the winding device.

Figure 2:
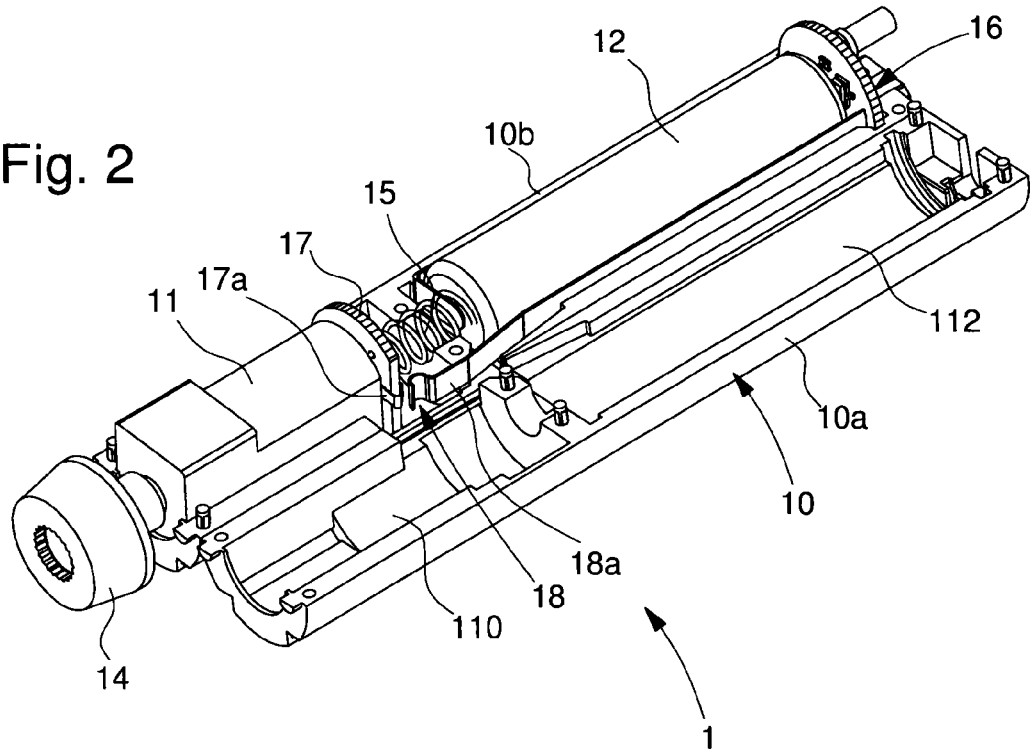
FIG. 2 is an open perspective view of the winding device according to the invention.

As can be observed in FIGS. 1 and 2, body 10 is of generally cylindrical shape and can open into two portions or half-shells 10*a*, 10*b* along the length of device 1, with the two portions connected to each other for example by means of screws (not shown). Alternatively, the two half-shells forming body 10 may be hinged on one another to make it easier to change the parts forming the device.

Body 10 may be made of a plastic material, or of a metallic material. It will be understood here that other materials could have been envisaged by those skilled in the art within the scope of the present invention.

In this example, device 1 also includes means 19 for driving the crown disposed at the other free end of body 10 of device 1, namely at the opposite end to that receiving electronic control circuit 16. Drive means 19 are secured to output shaft 11 and are intended to rotatably drive the watch crown.

Advantageously, electronic control circuit 16 may have means 13 of charging battery 12, such as a USB or micro-USB port. A light display such as an LED (light emitting diode) for example, may indicate the state of charge of battery 12.

According to the invention, device 1 includes a spring 15 positioned between battery 12 and motor 11 to permit motor 11 to slide inside its housing 110, with drive means 19, motor 11 and housing 110 being configured so that the motor can be guided and slid along the longitudinal axis of the body between at least two positions. Advantageously, body 1 may have a housing of cylindrical shape intended to receive spring 15, and disposed between housings 110 and 112 of motor 11 and battery 12.

As can be observed in the Figures, battery 12, motor 11, spring 15, drive means 19 and hollow endpiece 14 are aligned along the same axis traversing body 10 of device 1 lengthwise. This arrangement of the constituent elements of device 1 provide a compact and easy-to-operate device.

According to the illustrated example, the device includes a switch 18 disposed inside body 1 of device 10 and cooperating with a second electronic circuit, called motor circuit 17, fixed to the motor and sliding with motor 11.

Motor circuit 17 includes a switch contact 17*a* cooperating with a contact strip 18*a* forming a switch 18, which can be opened or closed in order to supply and/or shut off power to said motor 11.

As can be observed in FIG. 2, strip 18*a* of switch 18 extends along battery housing 112 and housing 110 of motor 11, one of the ends of strip 18*a* being in immediate proximity to contact 17*a* of motor circuit 17, and the other end being in contact with one of the positive or negative poles of battery 12 in electronic control circuit 16.

According to the invention, motor 11 and drive means 19 can slide from a rest position, seen in FIG. 3*a*, in which switch 18 is open (contact 17*a* remote from strip 18*a*) and motor 11 is not supplied with power, to an operating position, seen in FIG. 2*b*, in which switch 18 is closed (contact 17*a* in contact with strip 18*a*) and motor 11 is supplied with power.

The change from the rest position to the operating position is obtained by pressing drive means 19 against the watch crown in order to move motor 11 and stress spring 15 so that contact 17*a* of motor circuit 17 enters into contact with strip 18*a* of switch 18 and so that motor 11 is supplied with power to start the rotation of drive means 19.

According to a particular embodiment of the invention seen in FIG. 3*c*, motor 11 has a third position in which motor 11 is not supplied with power when the pressure exerted on drive means 19 exceeds a predetermined threshold. This case may occur, for example, when the user exerts too much pressure on the crown.

As illustrated in FIGS. 1 and 2, drive means 19 include a hollow endpiece 14 intended to cooperate with the crown, hollow endpiece 14 having a cavity 140 for receiving the watch crown.

Advantageously, the hollow crown 14 may be made of an elastomeric material having a sufficiently high friction coefficient to rotatably drive the watch crown when motor 11 is in an operating position or having a shape adapted to fit the crown.

According to an embodiment of the invention, hollow endpiece 14 may be removably connected to drive means 19 in order to mount different endpieces on device 1 and thus adapt to fit any type of crown, particularly with various existing diameters.

In this example, electronic control circuit 16 includes torque limiting means and/or revolution counter means in order to avoid forcing the watch crown when the mainspring is wound. Typically, the torque limits are comprised between 10 mNm and 50 mNm. These values are preferably adjustable and will be adjusted by the designer or the manufacturer depending on the type of watch to be wound.

Advantageously, the torque limiting means and/or said revolution counter means can be associated with display means such as an LCD screen displaying various information relating to the winding torque and/or to the number of revolutions.

Winding device 1 according to the invention operates as follows. The user grasps winding device 1 in one hand and a timepiece, such as a manual watch, in the other hand. The user then positions the timepiece crown in hollow endpiece 14 so that the crown is housed inside cavity 140. Motor 11 is then in a rest position as illustrated in FIG. 3*a*.

The user then presses device 1 and, in particular, hollow endpiece 14 towards the watch crown so that motor 11 moves into the operating position as illustrated in FIG. 3*b*. When the user presses hollow endpiece 14 of device 1 against the watch crown, this has the effect of moving drive means 19 and motor 11 and of stressing spring 15 until contact 17*a* of motor circuit 17 comes into contact with strip 18*a* thus closing switch 18. Motor 11 is then supplied with power by battery 12 and starts the rotation of hollow endpiece 14.

The user can then hold motor 11 in the operating position until the crown has made the number of revolutions necessary to completely wind the barrel of the watch. Once this number of revolutions is accomplished, the electronic system detects either that the maximum predefined torque is reached (as the crown is blocked since the spring is completely wound) or that the number of revolutions corresponds to a predefined number of revolutions, and stops driving the motor which is switched off. The user then releases the pressure exerted on the crown so that spring 15 pushes motor 11 into its rest position and thus shuts off power by breaking the contact between contact 17*a* of motor circuit 17 and strip 18*a* of switch 18.

As a result of the various aspects of the invention, there is provided a winding device 1 that is easy for a user to handle and to use, and which does not require operation of a switch to actuate the device.

Naturally, other embodiments could have been envisaged by those skilled in the art without thereby departing from the scope of the invention defined by the claims below.

LIST OF PARTS

1. Winding device
10 Body of the device
11 Electric motor
110 Motor housing
12 Battery
112 Battery housing
13 Charging means

14 Hollow endpiece
140 Hollow endpiece cavity
15 Spring
16 Electronic control circuit
17 Motor circuit
17*a* Motor circuit contact
18 Switch
18*a* Switch strip
19 Drive means

What is claimed is:

1. A device for winding a mainspring of a timepiece with a crown, the device including:

a body having a housing inside which are respectively arranged a motor, an electronic motor control circuit for controlling the motor and a powering device for powering the circuit and the motor, means for driving the crown disposed at one of the ends of the body of the device and secured to an output shaft of the motor, intended to rotatably drive the timepiece crown, wherein the device includes a spring placed between the powering device and the motor to permit the motor to slide with the drive means inside the body of the device, the motor being arranged in the body to slide into at least two positions, including:

a rest position in which the motor is not supplied with power, and an operating position in which the motor is supplied with power in order to start the rotation of the drive means when the drive means are engaged and pressed onto the timepiece crown.

2. The device according to claim 1, wherein the motor has a third position in which the motor is not supplied with power when the pressure exerted on the drive means is greater than a predetermined threshold.

3. The device according to claim 1, wherein the device includes a switch cooperating with an electronic circuit, the electronic motor control circuit opening or closing the switch so as to supply or shut off power to the motor.

4. The device according to claim 1, wherein the electronic motor control circuit includes torque limiting means and/or revolution counter means.

5. The device according to claim 4, wherein the torque limiting means and/or the revolution counter means are coupled to means for displaying the torque and/or number of revolutions.

6. The device according to claim 1, wherein the drive means include a hollow endpiece intended to receive the crown.

7. The device according to claim 6, wherein the hollow endpiece is made of an elastomeric material.

8. The device according to claim 6, wherein the hollow endpiece is removably connected to the drive means.

9. The device according to claim 1, wherein the powering device includes a rechargeable battery and wherein the device includes means for charging the battery.

10. The device according to claim 1, wherein the powering device, the motor, the spring, the drive means and a hollow endpiece are aligned along a same axis traversing the body of the device lengthwise.

* * * * *